US005327166A

United States Patent [19]

Shimada

[11] Patent Number: 5,327,166

[45] Date of Patent: Jul. 5, 1994

[54] IMAGE FORMING APPARATUS INCLUDING A PLURALITY OF PRINTING HEADS HAVING DIFFERENT IMAGE DENSITIES

[75] Inventor: Hirokatsu Shimada, Tokyo, Japan

[73] Assignee: Minolta Camera Kabushiki Kaisha, Osaka, Japan

[21] Appl. No.: 883,266

[22] Filed: May 14, 1992

[30] Foreign Application Priority Data

May 15, 1991 [JP] Japan ..... 3-139685

[51] Int. Cl.[5] ..... B41J 2/32; B41J 2/325

[52] U.S. Cl. ..... 346/76 PH; 347/12; 347/15

[58] Field of Search ..... 358/298; 346/76 PH, 346/1.1; 400/120

[56] References Cited

FOREIGN PATENT DOCUMENTS 61-13262 1/1986 Japan .

61-233557 10/1986 Japan .

2-184471 7/1990 Japan .

*Primary Examiner*—Benjamin R. Fuller

*Assistant Examiner*—Huan Tran

*Attorney, Agent, or Firm*—Burns, Doane, Swecker & Mathis

[57] ABSTRACT

A head unit is disposed in proximity to a platen roller around which printing paper is wound and to be movable in parallel with the axis of the platen roller. The head unit is provided with a high density head having 24 heating elements of a predetermined area and a low density head having 12 heating elements of an area four times that of the high density head. Binary image data is separated into high density head data and low density head data by a data separating circuit. The high density head forms first partial image of high resolution based on the high density head data and the low density head forms second partial image with reduced recording defects at a high speed based on the low density head data both on the printing paper.

11 Claims, 7 Drawing Sheets

FIG. 1
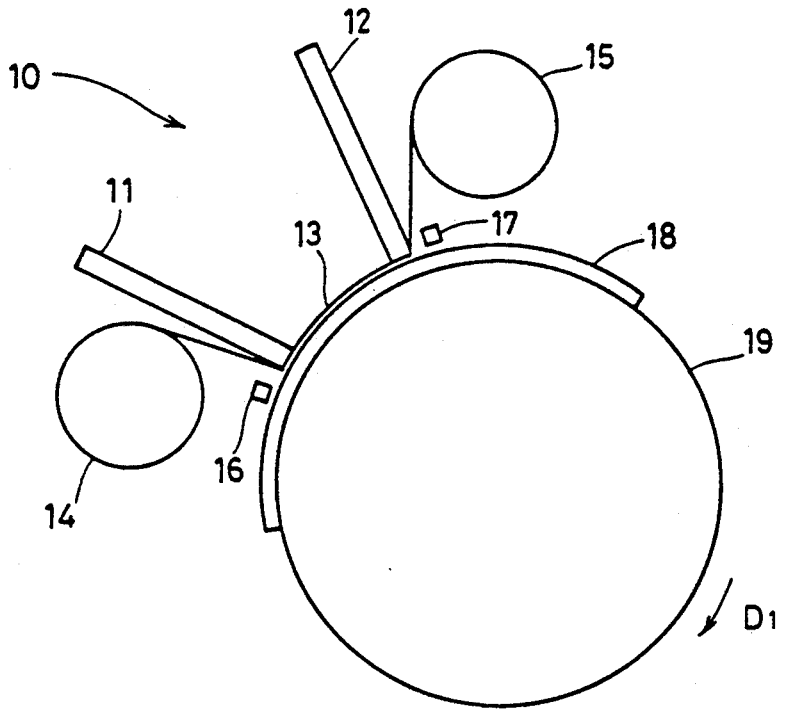
FIG. 2(A)
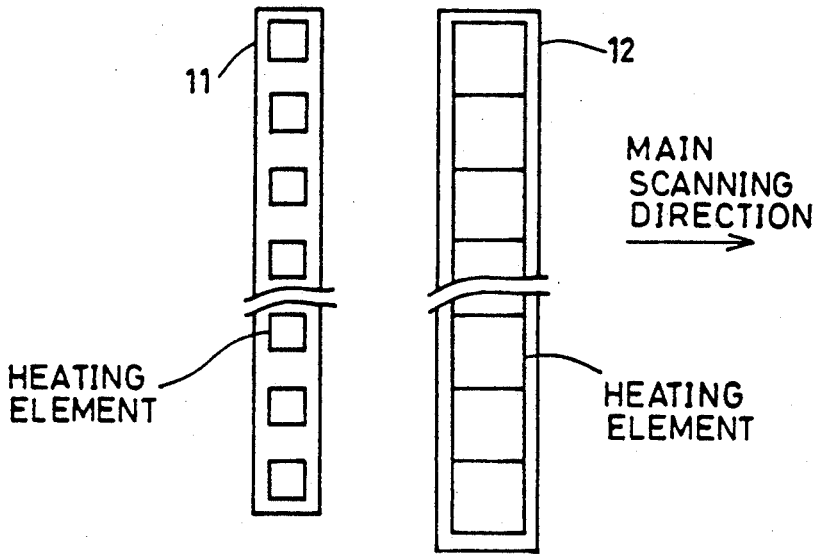
FIG. 2(B)

IMAGE FORMING APPARATUS INCLUDING A PLURALITY OF PRINTING HEADS HAVING DIFFERENT IMAGE DENSITIES

BACKGROUND OF THE INVENTION

1. Field of the Invention

The present invention relates generally to image recording apparatuses such as printers for recording image on a recording medium, and more particularly, to image forming apparatuses having a plurality of printing heads.

2. Description of the Related Art

With reference to FIG. 8, a conventional image recording apparatus, for example, a dot matrix type thermal printer, includes a platen roller 73 around which printing paper 72 is wound and a head unit 70 for printing image on the printing paper 72. The head unit 70 includes a printing head 71, an ink ribbon 74 and reels 75 and 76.

The platen roller 73 is rotatably supported by a frame (not shown). The printing paper 72 is wound around the circumferential surface of the platen roller 73. The printing head 71 is provided in proximity to the platen roller 73. The printing head 71 is rectangular in shape with a surface opposing to the circumferential surface of the platen roller 73 on which surface a plurality of heating elements (for example, 24 elements) are arranged linearly along a rotation direction (sub-scanning direction) of the platen roller 73. Each heating element has the same shape and each distance between adjacent heating elements is also the same. Each heating element is heated in a short time period when a voltage is applied thereto discharges heat in a short time period when no voltage is applied.

The two reels 75 and 76 are disposed in proximity to the printing head 71. The ink ribbon 74 slides on the surface of the printing head 71 on which the heating elements are provided to be fed from the reel 75 to the reel 76. When a heating element of the printing head 71 is heated, ink on the ink ribbon 74 in contact with the heating element is melted and attached to the printing paper 72. The head unit 70 including the printing head 71, the ink ribbon 74 and the reels 75 and 76 is capable of reciprocating in parallel with the axis of the platen roller 73, and the image is formed on the printing paper 72 by using the printing head 71 while the head unit 70 is reciprocating.

In a conventional image recording apparatus, the respective heating elements disposed on the printing head 71 have substantially the same shape. Therefore, each pixel of image recorded by the printing head 71 has the same area. Thus, solid printing (painting out a predetermined region in fixed concentration), for example, requires a long period of time to form image. Solid-printing of an area much larger than a pixel area of image formed by a heating element produces, for example, blank (a part of a solid-printed region has a concentration lower than that of the remaining part of the region). A pixel of an increased area formed by the heating element enables image formation in a short time period, while reducing defective image such as blank. However, resolution of the formed image is deteriorated.

SUMMARY OF THE INVENTION

Therefore, an object of the present invention is to reduce a time required for an image forming apparatus to form image without reducing resolution of recorded image.

Another object of the present invention is to prevent an image forming apparatus from producing blank without reducing resolution of recorded image.

A further object of the present invention is to provide a method of forming image which reduces a time required for forming image and prevents blank without reducing resolution of recorded image.

The above-described objects of the present invention can be achieved by an image forming apparatus including a plurality of printing heads having different pixel densities and a separator to separate image data according image density. That is, the plurality of printing heads having different pixel densities are driven according to a pixel density of image to be formed. As a result, image with low pixel density is formed by using a printing head having low pixel density, while image with high pixel density is formed by using a printing head having high pixel density. Image with high density is formed by a printing head corresponding thereto, resolution of the image will not be degraded. Since a low pixel density printing head is capable of printing a wide range at a time, image of low pixel density can be formed in a short time period.

As a result, the image forming apparatus is provided wherein a time required for forming image is reduced without degrading resolution of recorded image.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic diagram showing a structure of a thermal printer according to the present invention.

FIG. 2A, 2B and diagrams showing arrangements of heating elements of high density head respectively and a low density head.

DESCRIPTION OF THE PREFERRED EMBODIMENTS

Figure 3:
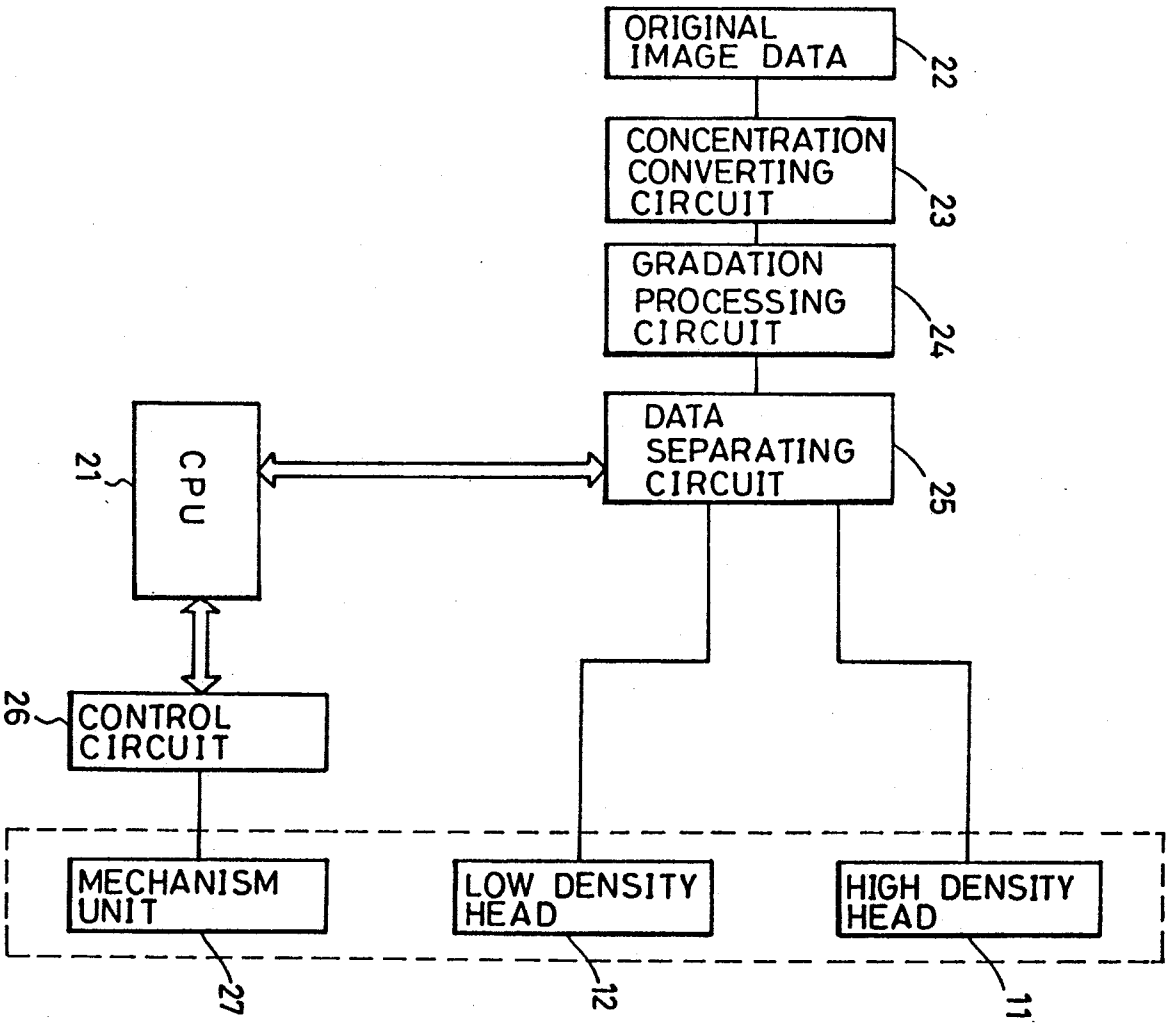
FIG. 3 is a diagram showing CPU and its peripheral circuits of the thermal printer according to the present invention.

One embodiment of the present invention will be described in the following with reference to FIGS. 1 to 7.

With reference to FIG. 1, an image recording apparatus according to the present embodiment includes a platen roller 19 around which printing paper 18 is wound and a head unit 10. The head unit 10 includes a high density head 11, a low density head 12, an ink ribbon 13, reels 14 and 15, and sensors 16 and 17.

The platen roller 19 has a cylindrical shape and has its axis rotatably supported by a frame (not shown).

The printing paper 18 is wound around the circumferential surface of the platen roller 19. The head unit 10 is disposed in proximity to the circumferential surface of the platen roller 19. The head unit 10 is capable of shifting in the direction of the axis of the platen roller 19.

The reels 14 and 15 are rotatably attached to a unit frame (not shown ). The reels 14 and 15 are disposed at a predetermined distance apart form each other in a direction of the circumference of the platen roller 19. The opposite ends of the ink ribbon 13 with ink immersed therein are wound around the reels 14 and 15. The ink ribbon 13 passing between the reels 14 and 15 is wound up by the reel 15 to be fed from the reel 14 toward the reel 15.

The high density head 11 and the low density head 12 are arranged in parallel with each other and apart from each other by a predetermined distance in the direction of the circumference between the reels 14 and 15. The high density head 11 and the low density head 12 are allowed to move close to and away from the circumferential surface of the platen roller 19, thereby pressing the ink ribbon 13 on the printing paper 18.

The high density head 11 and the low density head 12 are disposed at a distance of a width of one line from each other in the sub-scanning direction. The sub-scanning direction denotes a circumferential direction of the platen roller 19. One recording performed by the head unit 10 in the main scanning direction (perpendicular to the sub-scanning direction) results in printing of one line on the printing paper 18.

The sensors 16 and 17 are arranged near the circumferential surface of the platen roller 19. The sensor 16 is disposed near the end portion of the high density head 11 and the sensor 17 is disposed near the end portion of the low density head 12. The sensors 16 and 17 are optical sensors, for example, for detecting whether the printing paper 18 exists between the sensors 16 and 17 and the platen roller 19.

The high density head 11 is formed as a rectangular plate with one end portion, that is, a surface opposing to the circumferential surface of the platen roller 19, having a plurality of heating elements linearly disposed thereon. The high density head 11 includes, for example, 24 heating elements. All of these heating elements have the same shape and area and arranged in one row along the rotation direction of the platen roller 19. The low density head 12 includes 12 heating elements, half the number of those of the high density head 11. These heating elements each have an area four times as large as that of the high density head 11. That is, assuming that the heating element is rectangular in shape, the low density head 12 has the size twice as large as that of the high density head 11 both in length and width directions. The length of the row of the heating elements of the high density head 11 is the same as that of the row of the heating elements of the low density head 12.

FIGS. 2(A) and (B) are schematic diagrams respectively showing arrangements of heating elements of the high density head 11 and the low density head 12.

Application of a voltage heats the heating elements of the high density head 11 and the low density head 12 in a short time period, while application of no voltage causes them to discharge heat in a short time period. When a voltage is applied to the heating element of the high density head 11 or the low density head 12 to heat the same, the ink on the ink ribbon 13 in contact with the heating element is melted and attached to the printing paper 18. As a result, ink with the area corresponding to the area of the heating element is attached to a predetermined place of the printing paper 18. Therefore, the high density head 11 forms image with pixels of small area, while the low density head 12 forms image with pixels of area larger than those of the high density head 11.

FIG. 3 is a block diagram showing a CPU and its peripheral circuits of an image recording apparatus according to the present embodiment.

Original image data 22 transferred from an external memory, for example, which data is represented as a digital signal of multi-value (plural bits) for each pixel, is input to a concentration converting circuit 23. The concentration converting circuit 23 effects reverse $\gamma$ conversion of the original image data 22 by using a look-up table system or the like and corrects the reverse-$\gamma$-converted data based on ink light-emission characteristics. The data, after being converted and corrected, is applied to a gradation processing circuit 24 which circuit converts the input multi-value image data into binary image data by a dither method or a dot matrix method.

The binary image data output from the gradation processing circuit 24 is applied to a data separating circuit 25. The data separating circuit 25 separates the binary image data into high density head data (first image data) and low density head data (second image data).

A voltage is applied to the heating elements of the high density head 11 based on the high density head data separated by the data separating circuit 25. Similarly, a voltage is applied to the heating elements of the low density head 12 based on the low density head data.

A control circuit 26 controls operation of a mechanism unit 27 such as the head unit 10 and the platen roller 19. In other words, the control circuit 26 synchronizes operations of the head unit 10, the platen roller 19 and the like with each other to form predetermined image on the printing paper 18.

A CPU 21 includes a ROM for storing a program and a RAM for use as a work area and the like. The CPU 21 gives instructions of a procedure for separating data to the data separating circuit 25. Image data is separated into high density head data and low density head data following the procedure. The CPU 21 controls time to apply a voltage to the high density head 11 and the low density head 12 based on the high density head data and the low density head data in accordance with the flow chart of FIG. 4. The CPU 21 also controls the control circuit 26.

Figure 4:
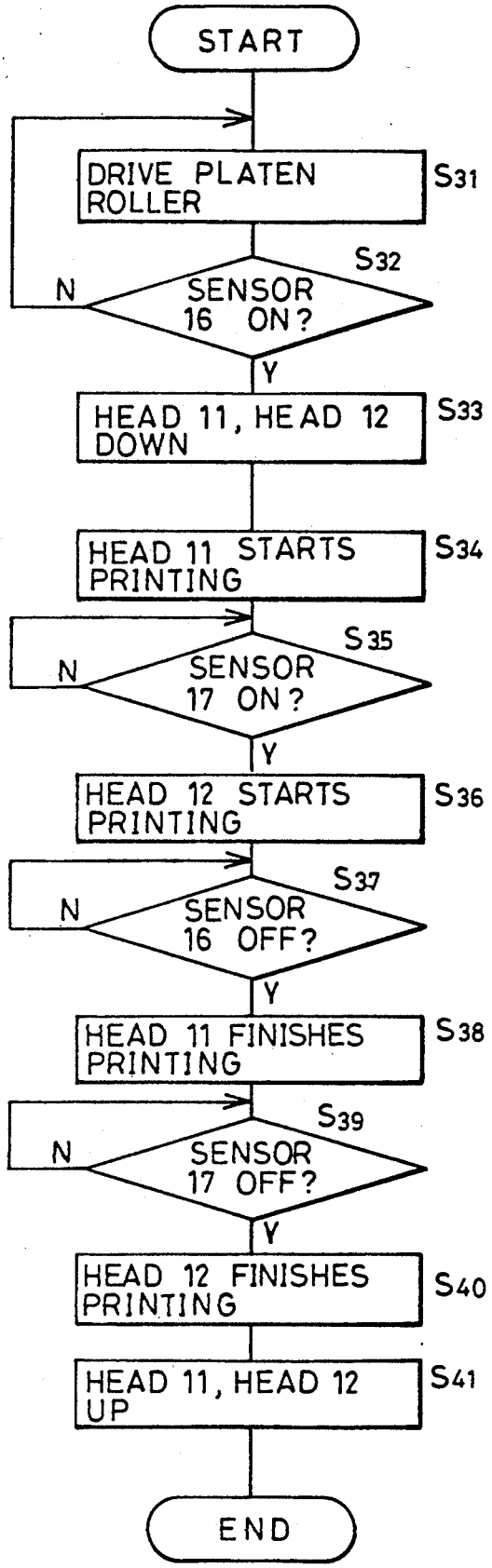
FIG. 4 is a flow chart illustrating a schematic operation of the thermal printer according to the present invention.

With reference to FIG. 4, a schematic operation of the image recording apparatus according to the present invention will be described.

When the platen roller 19 starts rotating in the rotation direction D1 (see FIG. 1) (\$31), the printing paper 18 wound around the platen roller 19 is shifted in the rotation direction D1. Then, the printing paper 18 comes near to the sensor 16 to determine whether the sensor 16 is turned on or not (\$32). If the sensor 16 is off (NO in \$32), the platen roller 19 keeps on rotating. When the printing paper 18 comes near to the sensor 16 to find the same to be on (YES in \$32), the high density head 11 and the low density head 12 come near to the platen roller 19 (\$33). The high density head 11 and the low density head 12 press the ink ribbon 13 on the printing paper 18 or the platen roller 19, thereby stopping the two heads 11 and 12.

The respective heating elements of the high density head 11 are supplied with a voltage and heated in accordance with high density head data. The ink immersed in the ink ribbon 13 is melted by the heat of the heating elements and attached to the printing paper 18, thereby forming image (S34).

The head unit 10 reciprocates in parallel with the axis of the platen roller 19 to form image (the main scanning direction), whereby the high density head 11 forms partial image on the first line of the printing paper 18. Then, when the platen roller 19 rotates toward the rotation direction D1 to move the printing paper 18 by a distance equivalent to a width of the one line, the platen roller 19 stops rotating. Subsequently, the head unit 10 reciprocates in parallel with the axis of the platen roller 19 to form partial image on the subsequent second line. Repetition of such operation causes the high density head 11 to form partial image for every line on the printing paper 18.

When the platen roller 19 rotates in the rotation direction D1, the printing paper 18 comes near to the sensor 17. Then, determination is made as to whether the sensor 17 is turned on or not (S35). When the sensor 17 is off (NO in S35), the printing paper 18 comes near to the sensor 17 to continue making determination of S35 until the sensor 17 is turned on. As a result, image is being formed on the printing paper 18 by the high density head 11 from the turning-on of the sensor 16 until the same reaches the sensor 17. Then, when the printing paper 18 reaches the sensor 17 to turn on the same (YES in S35), S36 is performed.

In S36, the heating elements of the low density head 12 are heated by application of a voltage thereto based on low density head data, similarly to the operation in S34. The ink immersed in the ink ribbon 13 is melted by the heat of the heating elements and attached to the printing paper 18, thereby starting image formation ( S36 ).

The head unit 10 reciprocates in parallel with the axis of the platen roller 19 to record image, whereby the low density head 12 forms partial image on said first line of the printing paper 18. At the same time, the high density head 11 forms partial image on the third line of the printing paper 18. Then, while the low density head 12 forms partial image on the second line, the high density head 11 forms partial image on the fourth line. In this way, the two heads 11 and 12 form their partial image for each line.

Determination is made as to whether the sensor 16 is turned off or not (S37). In other words, it is determined whether the printing paper 18 wound around the platen roller 19 has passed through the sensor 16 after further rotation of the platen roller 19 in the rotation direction D1. If the sensor 16 is on (NO in S37), determination of S37 is continued. When the printing paper 18 has passed through the sensor 16 to turn off the same (YES in S37), the high density head 11 finishes forming partial image (S38).

Then, determination is made as to whether the sensor 17 is turned off (S39). This is the determination as to whether the platen roller 19 rotates in the rotation direction D1 to finish passing the printing paper 18 wound around the platen roller 19 through the sensor 17. If the sensor 17 is on (NO in S39), determination of S39 is continued. When the printing paper 18 has passed through the sensor 17 to turn off the same (YES in S39), the low density head 12 finishes forming partial image (S40).

Then, the two heads 11 and 12 move away from the platen roller 19 (S41), thereby finishing image recording operation. As a result, the partial image by the high density head 11 and the partial image by the low density head 12 form one image as a whole.

Figure 5:
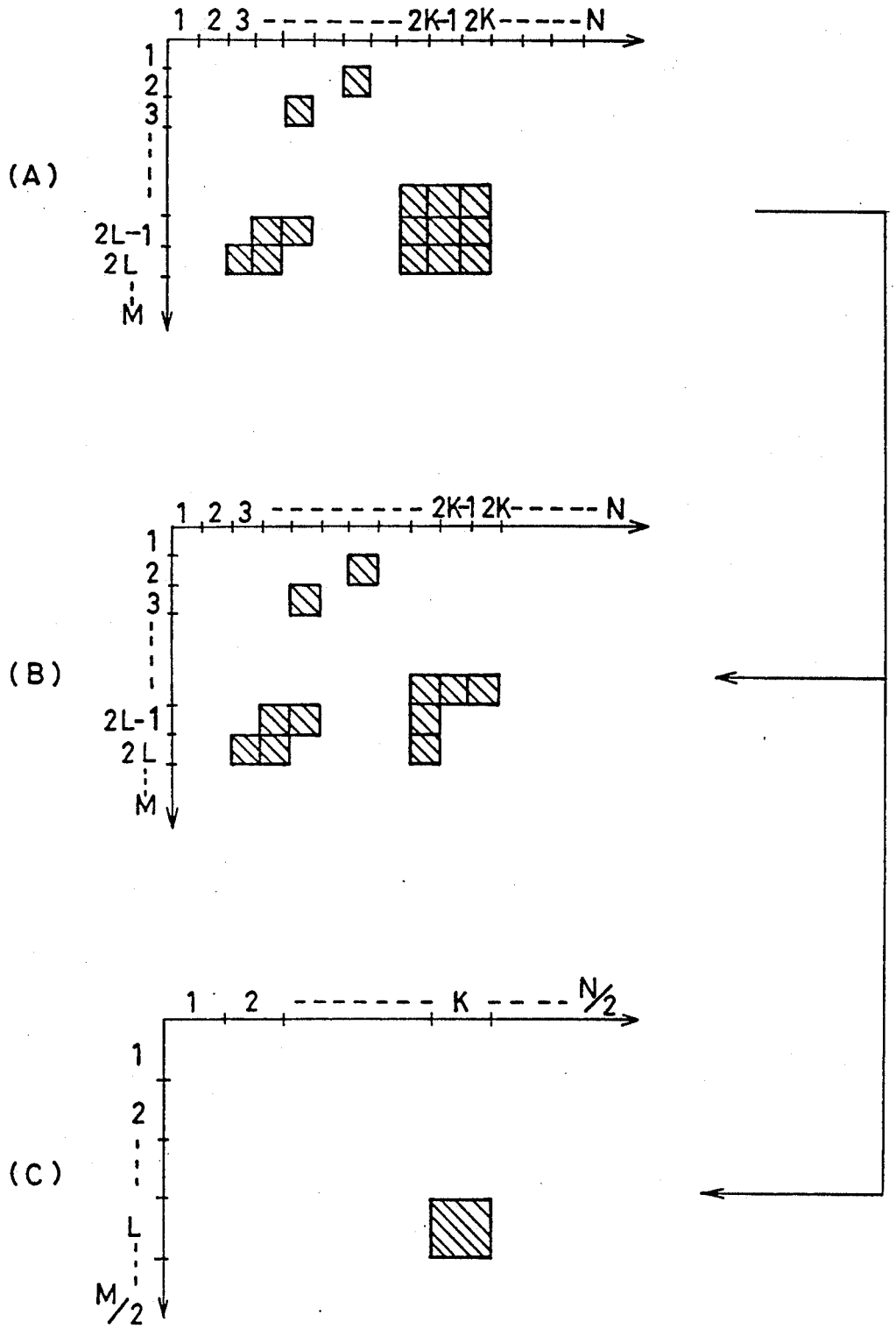
FIG. 5 is a diagram showing binary image data, high density head data and low density head data of an image recording apparatus according to the present invention.

FIG. 5 shows binary image data (image information), high density head data and low density head data.

FIG. 5(A) shows binary image data input to the data separating circuit 25. The binary image data includes M×N pixels. In FIGS. 5 (A), (B) and (C), rectangular regions painted out by slant lines denote that data of the pixel has a value of "1", while blank portions denote that pixel data has "0".

FIG. 5(B) shows high density head data including M×N pixel data similar to the binary image data of FIG. 5(A). FIG. 5(C) shows low density head data including (M/2)×(N/2) data, one-fourth the number of the pixel data of the high density head data.

Figure 6:
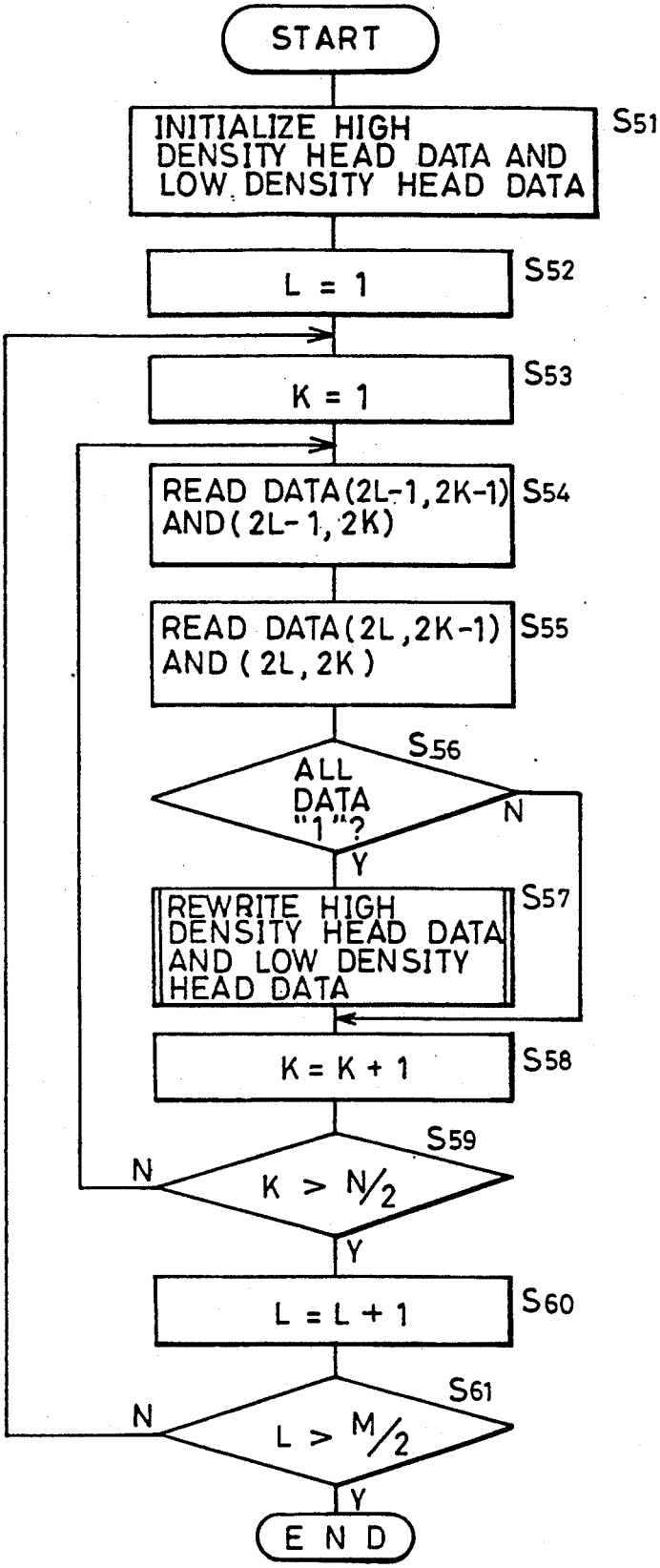
FIG. 6 is a flow chart showing steps of an operation in a data separation circuit according to the present invention.
Figure 7:
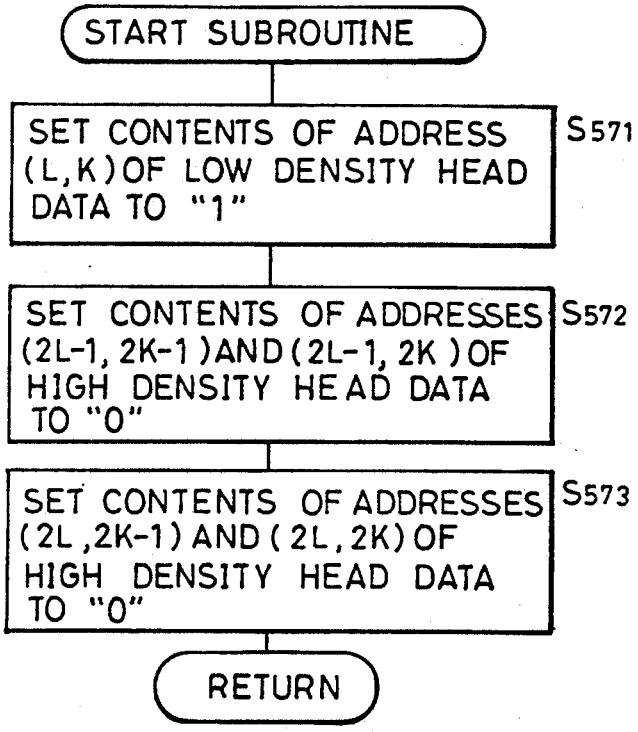
FIG. 7 a flow chart showing a subroutine of S57 in the flow chart of FIG. 6.
Figure 8:
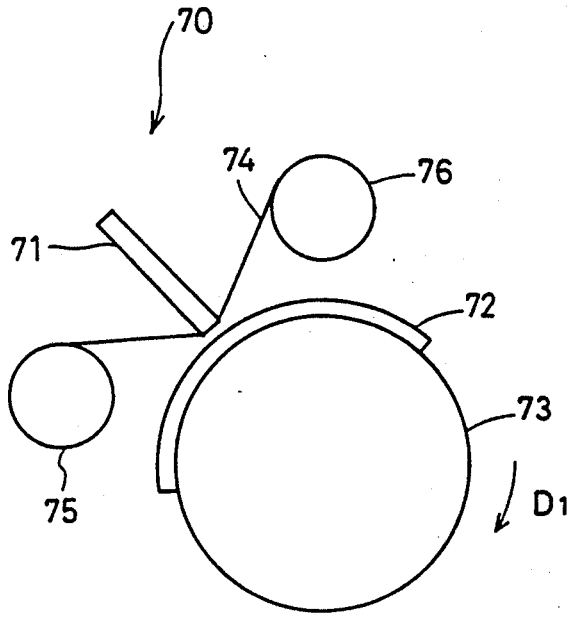
FIG. 8 is a schematic diagram showing a structure of a conventional dot matrix type thermal printer.

FIGS. 6 and 7 are flow charts showing procedures of the operation of the data separating circuit 25. The flow charts of FIGS. 6 and 7 will be described with reference to FIG. 5.

When the operation of the data separating circuit 25 is started, the contents of the high density head data and the low density head data are initialized (S51). In other words, binary image data value is copied in the high density head data and all values of the low density head data are set to "0".

Then, "1" is substituted for a variable L (S52) and also for a variable K (S53). The variable L represents addresses of the binary image data, the density head data and the low density head data on the vertical axis of FIG. 4, while the variable K represents an address on the horizontal axis.

Binary image data at (2L-1, 2K-1) and (2L-1, 2K) are read (S54). Herein, (2L-1, 2K-1) is assumed to represent the binary image data at the position designated by address of the (2L-1)th on the vertical axis and the (2K-1)th on the horizontal axis. That is, with L=1 and K=1, two data designated by the addresses at (1, 1) and (1, 2) of the binary image data are read. Similarly, binary image data at (2L, 2K-1) and (2L, 2K), that is, the data at (2, 1) and (2, 2) are read (S55).

Determination is made (S56) as to whether all the values of the four data (1, 1), (1, 2), (2, 1)and (2, 2) read in S54 and S55 are "1". If at least one of four data is not "1" (NO in S56), the value of K is incremented (S58). On the other hand, if all the four data are "1" (YES in S56), the subroutine of S57 is executed to rewrite the values of the high density head data and the low density head data. In other words, if all of four data adjacent to each other in the binary image data are "1", high density head data corresponding to the addresses of the data are rewritten into "0", while low density head data are rewritten into "1".

Then, the value of K is incremented (S58) and determination is made as to whether the value of K exceeds N/2 or not (S59). If the value of K does not exceed N/2 (NO in S59), S54-S59 will be repeated until the value of K exceeds N/2. If the value of K exceeds N/2 (YES in S59), the value of L is incremented (S60). In addition, determination is made as to whether the value of L exceeds M/2 (S61), if it does not exceed M/2 (NO in S61), the steps of S53 to S61 will be repeated until the value exceeds M/2. When the value of L exceeds M/2

(YES in S61), the operation of the data separating circuit 25 ends.

FIG. 7 shows a subroutine of S57. The values of high density head data and low density head data are re-written by carrying out the following procedure. The data at (L, K) of low density head data is rewritten into "1" (S571). Data at (2L-1, 2K-1) and (2L-1, 2K) of high density head data are rewritten into "0" (S572). Similarly, data at (2L, 2K-1) and (2L, 2K) of the high density head data are rewritten into "0" (S573) and the program returns to the flow chart of FIG. 6 to perform S58.

According to the flow charts shown in FIGS. 6 and 7, the binary image data of FIG. 5(A) is separated into the high density head data of FIG. 5(B) and the low density head data of FIG. 5(C). The high density head 11 and the low density head 12 form respective partial images on the same printing paper 18 based on the separated high density head data and low density head data. The two partial image are combined to form image on the printing paper 18 based on the original binary image data.

According to the present embodiment, therefore, the low density head 12 having a larger pixel area (an area of a heating element) than that of the high density head 11 is used to form image, so that time required for forming image can be reduced. In a case of solid printing, since the low density head 12 producing a larger pixel area is mainly used to form image, it is possible to drastically reduce a recording speed and avoid defective image such as blank. In addition, recording image by using both of the heads 11 and 12 does not cause a reduction in resolution of image as a whole.

Although the above-described embodiment is directed to the printer including the high density head 11 having 24 heating elements and the low density head 12 having 12 heating elements, the present invention is also applicable to a printer including a high density head 11 and a super-high density head comprising, for example, 48 heating elements. In this case, the high density head serves to gain a printing speed, while the super-high density head serves to maintain super-high resolution of image. The image recording apparatus according to the present invention may also include more heads differing from each other in an area of pixel formed by heating elements. The present invention is not limited to said thermal printer but is also applicable to an image recording apparatus such as an ink jet printer and an optical printer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image recording apparatus for recording an image on a recording medium based on image data, comprising:

a plurality of recording means for recording said image in different pixel densities, separating means for separating said image data according to respective pixel densities of said plurality of recording means, and controlling means for controlling said plurality of recording means based on said image data separated by said separating means.

2. The image recording apparatus according to claim 1, wherein respective pixels recorded by said plurality of recording means have areas different from one another.

3. An image recording apparatus for recording an image on a recording medium based on image data, comprising:

first recording means for recording a partial image on said recording medium in a first pixel density, second recording means for recording another partial image on said recording medium in a second pixel density lower than said first pixel density, separating means for separating said image data into first image data for said first recording means and second image data for said second recording means, and controlling means for controlling said first recording means based on said first image data and said second recording means based on said second image data.

4. The image recording apparatus according to claim 3, wherein said separating means separates said image data by performing a process for changing a plurality of said image data into one of said second image data.

5. The image recording apparatus according to claim 4, wherein said image data changed by said separating means include said image data represented by binary data in which all of the plurality of said image data adjacent to each other are "1".

6. An image recording apparatus for recording an image on a recording medium based on image data including a plurality of binary data, comprising:

first recording means for recording a first portion of said image on said recording medium in a first pixel density, second recording means for recording another portion of said image on said recording medium in a second pixel density lower than said first pixel density, determining means for determining whether a plurality of binary data adjacent to each other all are "1" in said image data, and controlling means for controlling said first and second recording means such that said another portion of said image is recorded by said second recording means when said determining means determines that all of the binary data are "1" and otherwise said first portion is recorded by said first recording means.

7. The image recording apparatus according to claim 6, wherein said first and second recording means record images in a same printing system.

8. The image recording apparatus according to claim 6, wherein said image data is represented by a data matrix of binary data in two directions, a main scanning direction and a sub-scanning direction, and said determining means makes determination on said image data in both of said main scanning direction and said sub-scanning direction.

9. An image recording apparatus for recording an image on a recording medium based on image data, comprising:

a platen roller for feeding said recording medium, first recording means for recording a first portion of said image on said recording medium in a first pixel density, second recording means provided downstream of said first recording means along a shifting direction of said platen roller for recording another portion of said image on said recording medium on said platen roller in a second pixel density different form said first pixel density, separating means for separating said image data into first image data to be used by said first recording means and second image data to be used by said second recording means, and controlling means for controlling said first recording means based on said first image data and said second recording means based on said second image data to form said image including the first image portion recorded by said first recording means and the another image portion recorded by said second recording means.

10. The image recording apparatus according to claim 9, further comprising:

first detecting means for detecting whether said recording medium is located at a position of said first recording means or not, and second detecting means for detecting whether said recording medium is located at a position of said second recording means or not, wherein said controlling means activates said first recording means when said recording medium is detected by said first detecting means and activates said second recording means when said recording medium is detected by said second detecting means.

11. A method of forming an image comprising the steps of:

dividing the image into a region having a low pixel density and a region having a high pixel density based on image data, forming a part of said image for said low pixel density region by using a printing head for printing in low pixel density, and forming a remainder of said image for said high pixel density region by using a printing head for printing image in high density.

* * * * *